US010155912B2

(12) United States Patent
Schweizer

(10) Patent No.: US 10,155,912 B2
(45) **Date of Patent: *Dec. 18, 2018**

(54) DEVICE AND METHOD FOR CONVEYING BULK MATERIAL

(71) Applicant: Schenck Process Europe GmbH, Darmstadt (DE)

(72) Inventor: Peter Schweizer, Langen (DE)

(73) Assignee: Schenck Process Europe GmbH, Darmstadt (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/695,238

(22) Filed: Sep. 5, 2017

(65) Prior Publication Data

US 2017/0362519 A1 Dec. 21, 2017

Related U.S. Application Data

(63) Continuation of application No. PCT/EP2016/000385, filed on Mar. 4, 2016.

(30) Foreign Application Priority Data

Mar. 5, 2015 (DE) ..... 10 2015 002 769

(51) Int. Cl.
*B65G 53/16* (2006.01)
*C10J 3/50* (2006.01)

(52) U.S. Cl.
CPC ..... *C10J 3/50* (2013.01); *C10J 2200/09* (2013.01); *C10J 2200/154* (2013.01); *C10J 2200/158* (2013.01)

(58) Field of Classification Search
CPC ..... B65G 25/12; B65G 47/19; B65G 47/58; B65G 53/252; B65G 53/528; B65G 65/44; C10J 3/50; C10J 2200/09; C10J 2200/154

(Continued)

(56) References Cited

U.S. PATENT DOCUMENTS 3,841,465 A * 10/1974 Miller, Jr. ..... F23G 5/444 241/247
3,897,889 A * 8/1975 Hindermann ..... B01F 13/1002 198/532
4,033,730 A * 7/1977 Baron ..... B01J 3/02 110/108

(Continued)

FOREIGN PATENT DOCUMENTS

EP 1 932 787 A1 6/2008
WO WO 03/013714 A1 2/2003

OTHER PUBLICATIONS

International Search Report dated May 17, 2016 in corresponding application PCT/EP2016/000385.

*Primary Examiner* — Joseph A Dillon, Jr.
(74) *Attorney, Agent, or Firm* — Muncy, Geissler, Olds & Lowe, P.C.

(57) ABSTRACT

A device and method for conveying bulk material, said device comprising a movable conveying member and an outer wall that is stationary in relation to the conveying member, wherein the device is connected to a further processing chamber for receiving and further processing the bulk material and a dynamic seal is used which seals with respect to the differential pressure between the further processing chamber and regions lying upstream in the process. A seal element of the dynamic seal formed of a sealant in the form of a material pattern or material seal that can be regenerated during operation of the conveying device, wherein the seal element is provided from a branch flow of the bulk material to be conveyed or from a separate sealant source.

13 Claims, 6 Drawing Sheets

(58) Field of Classification Search
USPC .... 406/47, 49; 198/528, 529, 531, 532, 536, 198/750.14, 750.7
See application file for complete search history.

(56) References Cited

U.S. PATENT DOCUMENTS 4,043,471 A * 8/1977 Trumbull ..... B01J 3/02 414/287
4,044,904 A * 8/1977 Trumbull ..... B01J 3/02 201/6
4,274,786 A * 6/1981 Svensson ..... D21B 1/06 162/18
4,302,143 A * 11/1981 Grimminger ..... B01J 3/02 414/173
4,400,125 A * 8/1983 Jensen ..... C10J 3/30 414/187
4,702,177 A * 10/1987 Narisoko ..... F23G 5/444 110/110
4,738,687 A * 4/1988 Smieskol ..... B01J 3/02 110/171
7,314,538 B2 * 1/2008 Lashofer ..... D21C 7/08 162/27
7,976,259 B2 * 7/2011 Craig ..... B01J 8/002 198/660
8,322,951 B2 * 12/2012 Kvalheim ..... B65G 65/36 406/109
9,211,515 B2 * 12/2015 Fink ..... B01J 8/002
9,533,839 B2 * 1/2017 Nierescher ..... B65G 53/14
9,617,086 B2 * 4/2017 Rusterholz ..... B65G 53/525
2007/0034642 A1 * 2/2007 Pendleton ..... B22D 11/108 222/56
2010/0126069 A1 * 5/2010 Stein ..... C10B 1/10 48/126
2014/0003968 A1 1/2014 Gross-D'Aillon et al.

* cited by examiner

DEVICE AND METHOD FOR CONVEYING BULK MATERIAL

This nonprovisional application is a continuation of International Application No. PCT/EP2016/000385, which was filed on Mar. 4, 2016, and which claims priority to German Patent Application No. 10 2015 002 769.7, which was filed in Germany on Mar. 5, 2015, and which are both herein incorporated by reference.

BACKGROUND OF THE INVENTION

Field of the Invention

The invention relates to a device for conveying bulk material and to a method for conveying bulk material. The bulk material, which can be a pasty, powdery, lumpy, free-flowable/free-flowing, or cohesive conveyed material, is to be conveyed into a pressure chamber.

Description of the Background Art

Conveying devices or pumps of this type, which are also referred to as dry material pumps, are used for introducing dry bulk materials such as, e.g., coal into a pressurized chamber, such as a gasification reactor.

When coal is processed in gasification reactors, high temperatures and/or pressures of 25 bar to 80 bar are customary for the efficient operation of the plant. Particularly with regard to the gasification of low-quality coal or in the case of fuels from biomass, certain requirements cannot be ignored with regard to the conveying of the particular bulk material. Usually, there should be no high costs for providing the base material, which includes its movement, comminution, classification, and storage. In addition, the conveying devices should be robust and inexpensive and the escape of process gases, which leads to pressure losses, should be largely avoided during the conveying process. In addition, it must be taken into account that particularly bulk materials in the form of fuels have very different characteristics and frequently exhibit fluctuations in residual moisture or moisture content, are coarse-grained, or even have aggressive properties or characteristics that attack the surface of the conveying device.

The loss of process gas with which the required pressure in the conveying device or a working space of the conveying device is generated relative to the ambient pressure is fundamentally dependent on the respective sealing of the working space. On the one hand, there are conveying devices, such as piston pumps, disk pumps, rotary feeders, or pressure containers arranged one behind the other, in which a seal is achieved by means of geometrically defined components. Mechanical seals, piston rings, or soft and hard sealing components running opposite to each other are used.

The bulk material to be conveyed has an influence on the sealing effect of the components insofar as the components wear more rapidly or more slowly depending on the particular nature of the bulk material. In the design of conveying devices of this kind, therefore, a compromise between the wear of the components and their replacement and the sealing must often be addressed with regard to the sealing effect.

Most of the aforementioned conveying devices or dry material pumps are relatively expensive, have a high energy loss, and are very inefficient overall.

For example, conveying devices which use seals in the form of material plugs made of the material to be processed can be found in WO 95/06610 A1 or U.S. Pat. No. 4,197,092. In this regard, these devices continuously convey the material into the pressure chamber. In both cases, however, a great deal of energy is required to compact the material plug to the extent that the desired sealing effect is achieved. The entire bulk material to be conveyed must be compacted in the conveying process either continuously or discontinuously to the density of the desired material plug. This is particularly difficult with inhomogeneous materials and also entails high wear on the components coming in contact with the plug.

In addition, all of the conveyed material must be processed before the conveying process to the extent that it can pass through the device and the compacting section. This increases the expenditure for the processing of bulk material before the conveying process.

SUMMARY OF THE INVENTION

It is therefore an object of the present invention to convey bulk material into a pressure chamber with the lowest possible energy expenditure and to guarantee the conveyance independently of fluctuating material properties. The disadvantages known from the prior art and the aforementioned disadvantages are overcome in this regard.

In an exemplary embodiment, the invention provides a device for conveying bulk material comprising a movable conveying member and an outer wall that is stationary in relation to the conveying member, wherein the device can be pressurized or is connected to a further processing chamber or a pressure chamber for receiving and further processing the bulk material. In this case, a dynamic seal seals with respect to the differential pressure between the further processing chamber and the regions lying upstream in the process. This means that the dynamic seal, disposed in the conveying device, must withstand the differential pressure between the further processing chamber and the regions lying upstream in the process, for example, the ambient pressure or a bulk material source. A dynamic seal can be understood here as a component or element that provides the sealing action between a movable part and a stationary part of the conveying device. In the present invention, a seal element of the dynamic seal made of a sealant is provided in the form of a material charge or material seal that can be regenerated during operation of the conveying device, wherein, in contrast to known conveying devices, the seal element is provided only from a branch flow of the bulk material to be conveyed and/or from a separate sealant source.

This has the advantage that no energy has to be applied for compacting the entire bulk material conveying flow but only for the branch flow or the separate sealant flow. In addition, also only a part of the bulk material is altered thereby with regard to its original properties, so that there is no need to restore the original properties before entry or upon entry into the pressure chamber.

Nevertheless, the seal element made of the bulk material or separate sealant acts as a regenerable sacrificial seal and the abrasion which necessarily occurs during operation can also be used/further treated during the gasification process. Furrows or depressions which are formed by wear, for instance, on the inner side of the conveying device, are compensated by the regeneration of the seal element with the bulk material or sealant and the associated filling of the depressions during the course of the process.

Thus, a conveying device with very high service lives can be produced at low energy costs for the sealing.

In this regard, the seal element of the dynamic seal can be provided as a primary or secondary seal. In the case of a primary seal, the seal element of the dynamic seal is formed entirely of the material of the bulk material branch flow or a separate sealant flow or a mixture of the two. Alternatively, the seal element can have a conventional shaping sleeve component and the filling of this sleeve component from the branch flow of the bulk material or the sealant flow can be provided as a secondary seal. In the case of the secondary seal, the sealing effect of the seal element results from the joint action of the sleeve component and the filling.

An embodiment of the invention provides that the dynamic seal can be provided as a translatory or rotary seal on the movable conveying member or the stationary outer wall of the conveying device.

Thus, this can be used, for example, in a conveying device which comprises a cylinder and in which a piston, which can be moved back and forth in the cylinder, is provided as the conveying member. Here, the dynamic seal can be arranged both radially on the cylinder wall and on the piston.

Accordingly, the seal element of the dynamic seal in the form of the material charge or material seal can be shaped as a sealing jacket.

In this case, it is advantageous if the sealing jacket has a wall thickness as small as possible, which, on the one hand, is large enough to maintain the arising forces and pressures during operation and, on the other hand, is so small that only a small mass and/or a small volume of the material charge or material seal are present.

The sealing effect is improved when the compacting device, the compaction path which is traversable by the compacting device, the sealing chamber, the cylinder, the shape, and the resistance force of the piston are matched to one another such that a radial outward striving of the sealing material is forced during compaction caused by the compressing device.

Alternatively, the seal element of the dynamic seal can also be arranged as a plug or disk on the end face of the reciprocable piston. In this case, either an already compacted plug or an already compacted disk can be used, or a compaction device can be arranged such that sealing material introduced into the conveying device can be processed into a seal element.

With regard to the material composition of the seal element of the dynamic seal, one additive or a plurality of additives may be added to the branch flow of the bulk material and/or to the separate sealant flow. Advantageously, these additives only have characteristics that are inert with respect to further processing in the pressure chamber. Thus, the material property of the bulk material to be conveyed is not adversely affected by the separate sealant flow or the additives.

For example, water, oil, for instance, waste oil, graphite, grease, or other lubricants, with preferably good sliding and/or lubricating properties, are conceivable as an additive. Preferably, the additive, on the one hand, optimizes the sliding properties of the seal element on the conveying device and, on the other hand, particularly in the case of liquid additives, improves the flowability of the sealing material in order to improve the feeding of the sealing material for the regeneration of the seal element.

An embodiment of the invention provides in addition that the seal element of the dynamic seal comprising a pasty or liquid material is provided. This property can be adjusted in its form, for instance, by the addition of liquid additives. The advantage of this property is the improved conveying capacity of the seal element for the purpose of regeneration. In this case, the removed density element is replaced by the feed under pressure from a source.

Furthermore, the invention provides a method for conveying bulk material into a pressurized chamber, in which method a seal element of a dynamic seal is formed from a branch flow of the bulk material flow to be conveyed and/or a separate seal flow for sealing a conveying device with respect to the ambient pressure or bulk material source.

In this case, the sealant can be conveyed continuously and discontinuously by means of a movable conveying member from the branch flow and/or seal flow into a working space of the conveying device, which space can be used for compacting.

Even if the sealant which is fed to the bulk material flow during operation of the conveying device is removed from a separate sealant flow, it can be processed together with the bulk material to be conveyed into the pressure chamber or the further processing chamber because this does not alter or worsen the material properties of the bulk material. The same applies to a sealant which has been removed from the bulk material flow and added to the additive in order to possibly improve the cohesion or the sliding properties.

A stable conveying device, on the one hand, and an efficiently operable conveying device, on the other, are realized in this way.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
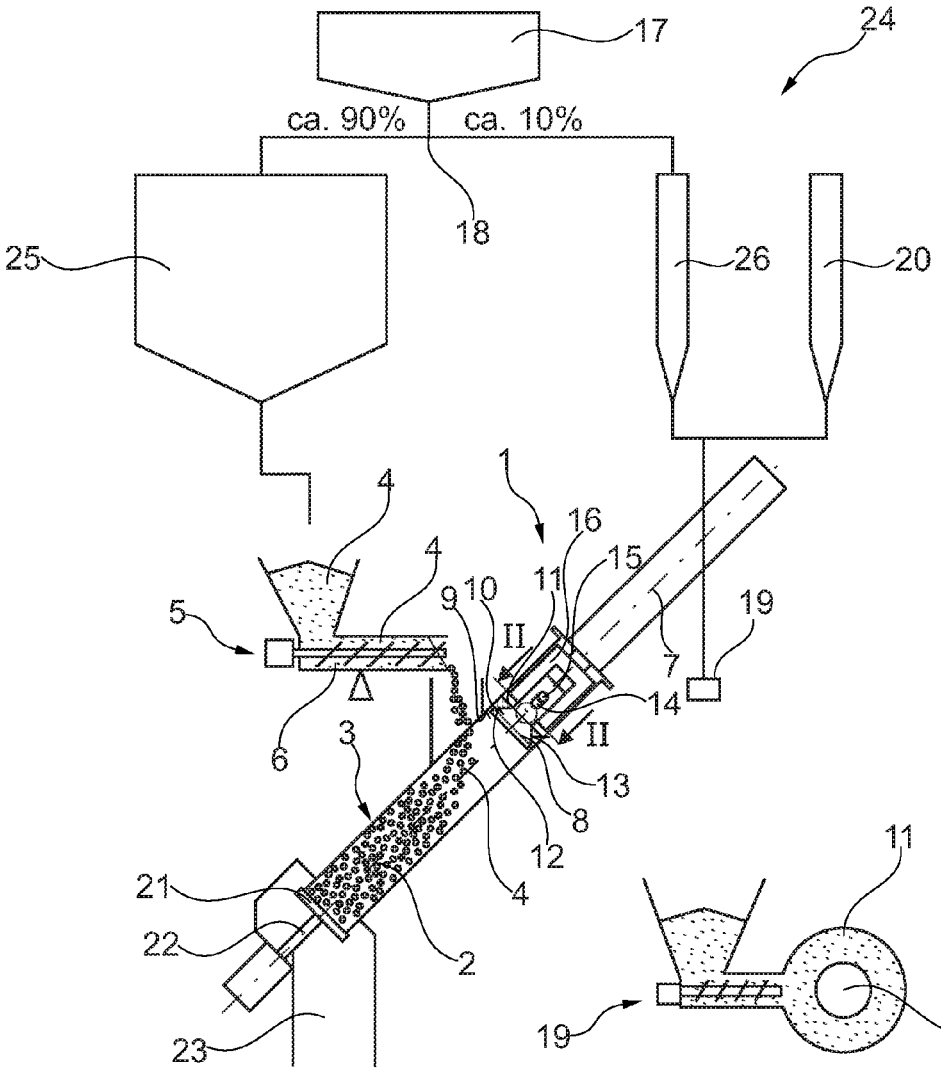
FIG. 1 shows in a schematic illustration an embodiment of a conveying device of the invention incorporated into a method of the invention.

FIG. 1 shows a first embodiment of a conveying device 1 of the invention. Conveying device 1 is designed as a solids pump. It has a cylinder 3 as a stationary outer wall and a piston 8 as a movable conveying member. Stationary outer wall 3 also defines a working space 2 in which piston 8 can be moved back and forth along a longitudinal axis 7. Working space 2 can be filled with bulk material 4. Bulk material 4 is removed from a bulk material source, which comprises a feed device 5 with a conveyor screw 6.

There is a sealing gap 10 between the outer side of piston 8 and an inner side or inner surface 9 of cylinder 3. Sealing gap 10 is sealed by means of a dynamic seal, the seal element 11 of which is provided in the form of a primary seal or a material seal. Seal element 11 is made annular and has an inner surface 12 which rests against a conical outer surface 13 of piston 8.

Piston 8 has a slot 14 in the manner of a long hole in which a pin 15 of a compacting device 16 is guided. Compacting device 16 is made in the manner of a hollow-bore shaft.

Seal element 11 is constructed from a branch flow of bulk material 4 but also contains a small quantity of additive elements and/or elements different from the bulk material.

Figure 2:
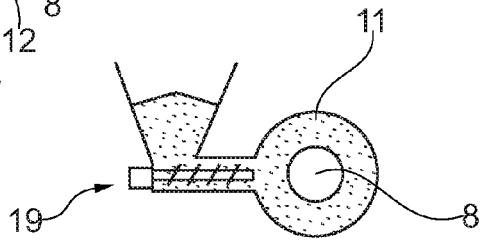
FIG. 2 shows a sectional view along the line II through the conveying device from FIG. 1 in the region of a sealant feed unit.

In the illustrated exemplary embodiment, bulk material 4 to be processed is first supplied from a starting material feeder 17 to a conveying flow divider or a conveying flow dividing device 18. In this regard, e.g., 90% of the bulk material to be conveyed is fed directly to feed device 5 via filter, screen, comminution, rolling, or grinding processes, and the remaining 10% of the material is fed after the same or similar preprocessing steps to a seal element feed unit 19 shown in FIG. 2.

In this case, seal element feed unit 19 can be designed as a "side feeder" or "top feeder." A so-called "side feeder" is shown in which the bulk material to be conveyed is introduced into working space 2 of conveying device 1 via a side inlet. As is evident from FIG. 1, an additive can optionally be fed to seal element feed unit 19 via an additive branch 20 and mixed with branch flow 26 of the bulk material flow.

The lower end of cylinder 3 has an outlet which projects into a further processing chamber 23. This outlet is closed by a closing component 21, so that the corresponding pressure can be built up for further processing in working space 2 of cylinder 3.

Figure 3:
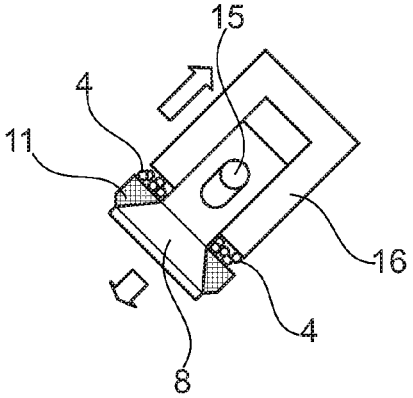
FIG. 3 shows the state of the conveying device when removing a compacting device from a produced seal element and with simultaneous movement of a piston of the conveying device in the direction of a further processing chamber.

FIG. 3 shows the filling of a sealing space for forming seal element 11 of the dynamic seal as a primary seal or a material seal. Whereas compacting device 16 moves counter to the direction of further processing chamber 23, piston 8 is retained by the friction of seal element 11 with respect to the inner wall of working space 2. As a result, a gap 10 opens whose volume corresponds approximately to the volume of the seal element removed by wear. This volume is subsequently replenished in the region of seal element feed unit 19 and thus regenerated.

Figure 4:
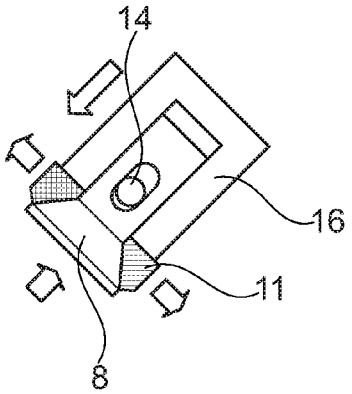
FIG. 4 shows the state of the reciprocation of the piston and the compacting device when the seal element is compacted.

In the next step, as shown in FIG. 4, compacting device 16 and piston 8 move toward one another as a result of the increasing pressure in working space 2; on the one hand, this leads to a compaction of the material of seal element 11 and, on the other hand, to a radial outward forcing of the material, the latter being radially limited by the outer wall of conveying device 1, here inner surface 9 of cylinder 3. In any case, a sealing gap 10 between the movable conveying member and conveying device 1 is closed by seal element 11.

Figure 5:
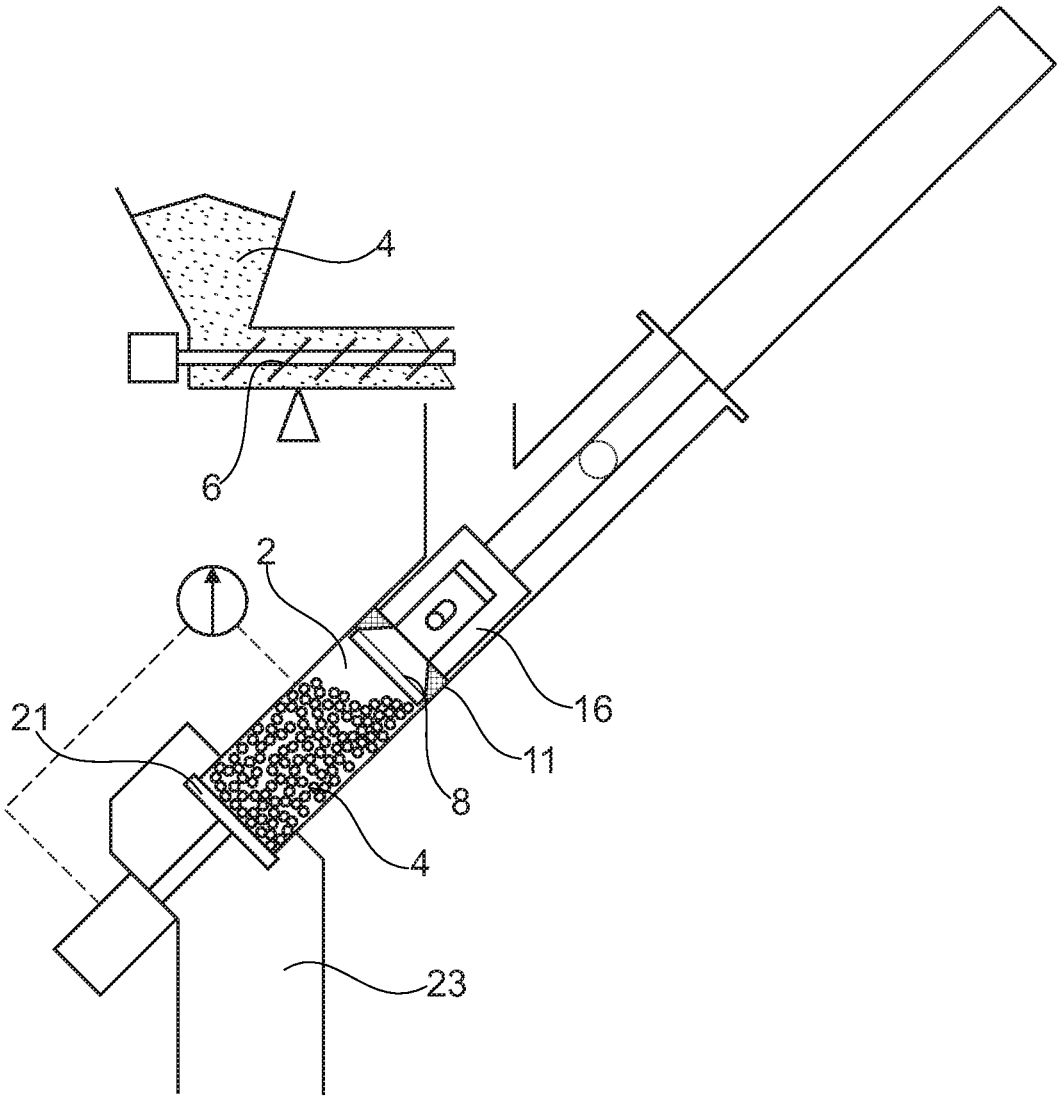
FIG. 5 shows the state of the conveying device when the bulk material flow is pressurized by the piston.

It is evident in FIG. 5 how in a subsequent step bulk material 4 is compacted from the bulk material flow to be conveyed in working space 2 of cylinder 3 and a pressure corresponding to pressure chamber 23 is established, which can only be realized by the presence of seal element 11.

Figure 6:
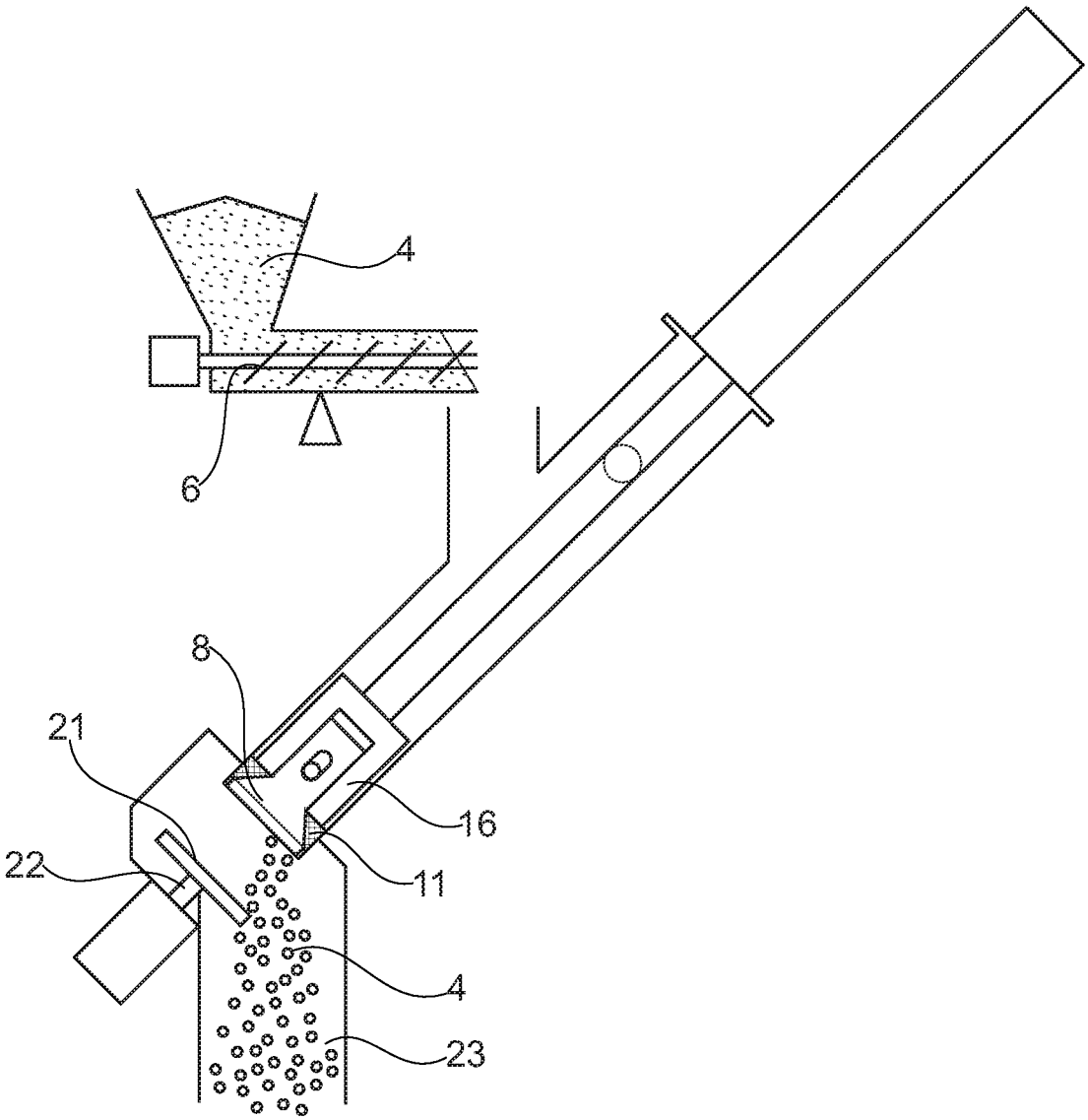
FIG. 6 shows a moment of introduction of the bulk material into the further processing chamber.

As soon as the defined pressure is reached, working space 2 of conveying device 1 can be opened, for instance, via an auxiliary piston 22, and a discharge of bulk material 4 as shown in FIG. 6 is made possible.

Figure 7:
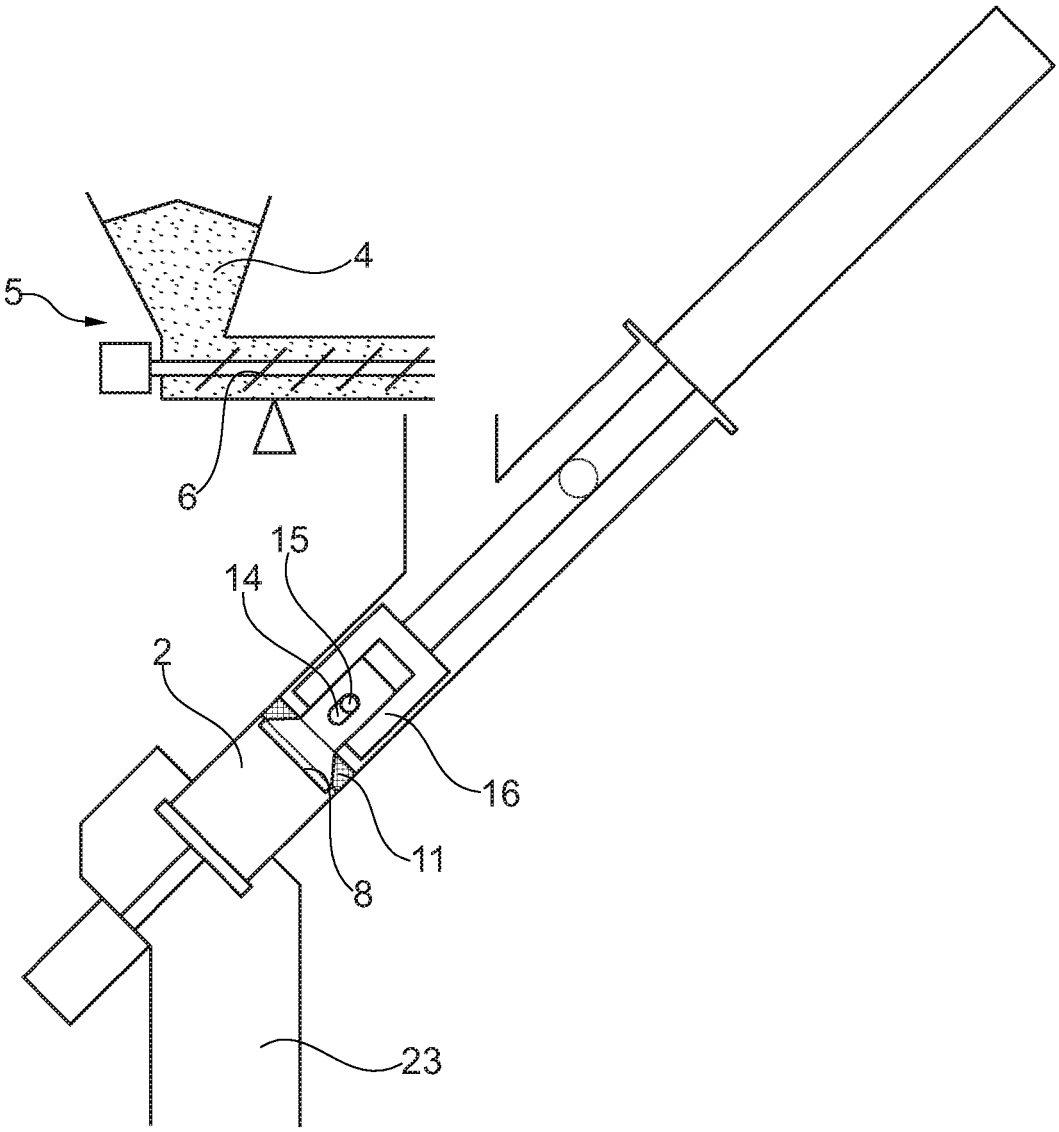
FIG. 7 shows the state of evacuating the working space of the conveying device.

In this case, however, bulk material 4 is largely not compacted but only working space 2 is brought to the pressure as it prevails in further processing chamber 23. After the compression phase from FIG. 5 and the ejection phase from FIG. 6, working space 2 of cylinder 3 is again closed off from further processing chamber 23. By retracting piston 8, working space 2 is also again evacuated as shown in FIG. 7.

Figure 8:
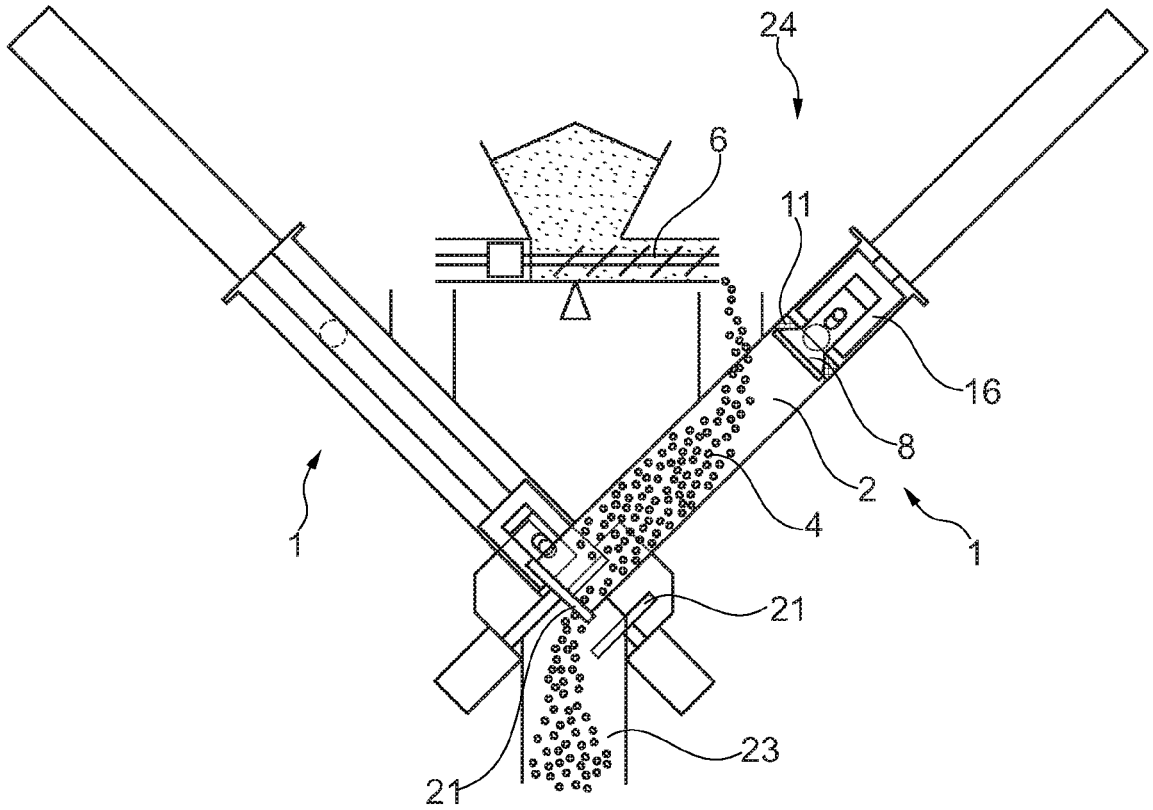
FIG. 8 shows an embodiment of a conveying device of the invention.

FIG. 8 shows an embodiment 24 of a conveyor system 1 of the invention. Here, two conveyor systems 1 of the invention are used perpendicular to one another. Both conveyor systems 1 have an outlet opening which opens into a further processing chamber 23, which can be part of a pressure vessel, for example. Advantageously, in the case of two combined conveyor systems 1, the discharge process takes place in the case of the one cylinder, when the compacting phase is already in progress in the other cylinder. In order to achieve an approximately continuous feed of further processing chamber 23, a plurality of such conveyor systems can also be combined with one another.

Figure 9:
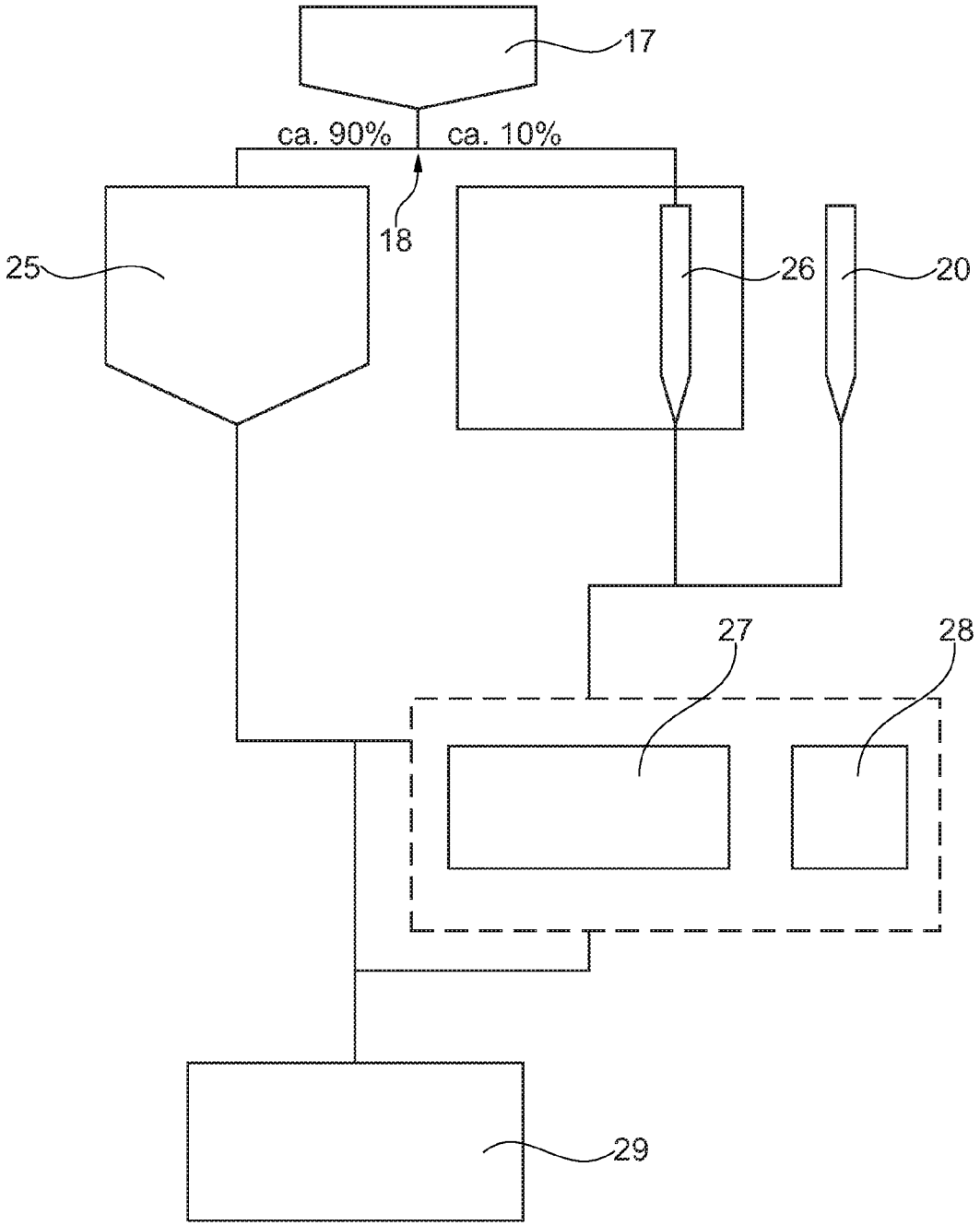
FIG. 9 shows an illustration of the method of the invention.

FIG. 9 shows again schematically the process of conveying the bulk material into further processing space 23. In a starting material feed, the bulk material flow to be conveyed is divided into a main flow and a branch flow 26 at a conveying flow dividing device 18. In addition, additives from an additive branch 20 can be added for the production of a seal element in the form of a material seal.

Whereas the fuel preparation takes place in a step 25, the dynamic seal can be produced as a primary or secondary seal in a separate step 27, as an alternative to the methods already described. For example, a material seal can be produced in the form of a disk or stopper. This can be done optionally with the addition of additives or by simple compaction. Alternatively, branch flow 26 can also be used for the production of a secondary seal which is filled into a shaping elastic seal element. An additional quality test 28 can be provided for checking the sealing effect of the primary or secondary seal. The further processing of prepared bulk material from fuel preparation 25 and from branch flow 26 with or without additives is then carried out in a step 29 in the further processing chamber, wherein the dynamic seal can be produced in the processing process itself or can be introduced into the conveying process as a finished seal.

The advantage of the conveying device of the invention and of the conveying method of the invention is that the energy required to seal the pressure chamber against the ambient pressure can be considerably reduced in comparison with compacting or continuously compacting conveying devices because the entire bulk material flow or conveying flow does not need to be compacted.

An approximately continuous charging of a further processing chamber 23 or of a pressure chamber can be achieved, however, by the combination of a plurality of conveyor systems.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for conveying bulk material, the device comprising:

a movable conveying member that conveys the bulk material;

an outer wall that is stationary in relation to the conveying member;

a dynamic seal that seals with respect to a differential pressure between a processing chamber and regions lying upstream of the processing chamber, the device being connected to the processing chamber that receives and further processes the bulk material; and a seal element of the dynamic seal comprising a sealant in a form of a material charge or material seal that is adapted to be regenerated during operation of the device, the seal element being provided from a branch flow of the bulk material to be conveyed or from a separate sealant source, wherein, the seal element provided from the branch flow of the bulk material to be conveyed or the seal element provided from the separate sealant source is conveyed to the processing chamber with the bulk material.

2. The device according to claim 1, wherein the seal element of the dynamic seal is provided as a primary or secondary seal.

3. The device according to claim 1, wherein the dynamic seal is provided as a translatory or rotary seal on the movable conveying member or the stationary outer wall of the device.

4. The device according to claim 1, wherein the device comprises a cylinder having the outer wall and a piston, which is adapted to be moved back and forth in the cylinder, wherein the piston is the conveying member.

5. The device according to claim 1, wherein the seal element of the dynamic seal in the form of the material charge or material seal is shaped as a sealing jacket.

6. The device according to claim 5, wherein the sealing jacket has a wall thickness which is large enough to maintain the arising forces and pressures during operation.

7. A device for conveying bulk material, the device comprising:

a movable conveying member that conveys the bulk material;

an outer wall that is stationary in relation to the conveying member;

a dynamic seal that seals with respect to a differential pressure between a processing chamber and regions lying upstream of the processing chamber, the device being connected to the processing chamber that receives and further processes the bulk material; and a seal element of the dynamic seal comprising a sealant in a form of a material charge or material seal that is adapted to be regenerated during operation of the device, the seal element being provided from a branch flow of the bulk material to be conveyed or from a separate sealant source, wherein the device further comprises a drum or a cylinder having the outer wall and wherein the conveying member is provided as a rotary wheel rotating in the drum or the cylinder.

8. The device according to claim 1, wherein the seal element of the dynamic seal in the form of the material charge or material seal contains one or more additives.

9. The device according to claim 1, wherein the seal element of the dynamic seal is provided in the form of the regenerable material charge or material seal made of a pasty or liquid material.

10. A method for conveying bulk material into a processing chamber, the method comprising:

sealing a conveying device for conveying the bulk material, the conveying device having a conveying member that is movable in relation to a stationary outer wall of the conveying device, the sealing of the conveying device being with respect to differential pressure between a processing chamber that is connected to the conveying device to further process the bulk material and regions of the conveying device lying upstream of the processing chamber; and providing a seal element of a dynamic seal to seal the conveying device, the seal element being a sealant in a form of a material charge or material seal that is adapted to be regenerated during operation of the conveying device, and the seal element being formed from a branch flow of the bulk material flow to be conveyed and/or from a separate sealant source, wherein the seal element provided from the branch flow of the bulk material to be conveyed and/or the seal element provided from the separate sealant source is conveyed to the processing chamber with the bulk material.

11. The method according to claim 10, wherein the sealant is conveyed continuously or discontinuously via a movable conveying member from the branch flow and/or the seal flow into a working space of the conveying device, which space is adapted to be used for compacting and/or compacted in it.

12. A method for conveying bulk material into a processing chamber, the method comprising:

sealing a conveying device for conveying the bulk material, the conveying device having a conveying member that is movable in relation to a stationary outer wall of the conveying device, the sealing of the conveying device being with respect to differential pressure between a processing chamber that is connected to the conveying device to further process the bulk material and regions of the conveying device lying upstream of the processing chamber; and providing a seal element of a dynamic seal to seal the conveying device, the seal element being a sealant in a form of a material charge or material seal that is adapted to be regenerated during operation of the conveying device, and the seal element being formed from a branch flow of the bulk material flow to be conveyed and/or from a separate sealant source, wherein the sealant for the seal element of the dynamic seal is added to the bulk material flow during operation of the conveying device and is processed together with the bulk material flow in the processing chamber.

13. The device according to claim 4, wherein the piston is moved back and forth within a working space in the cylinder, the working space receiving the bulk material from a main flow of the bulk material from a feed device, wherein a bottom surface of the piston faces the working space and conveys the bulk material received from the feed device and an upper surface of the piston faces away from the working space, and wherein the seal element is provided at and abuts the upper surface of the piston, so as to surround the upper surface.

* * * * *